United States Patent [19]

Jensen

[11] Patent Number: 4,545,300

[45] Date of Patent: Oct. 8, 1985

[54] SCREEN PRINTING APPARATUS AND PROCESS COMPRISING CHAMBER WITH MOVABLE UPPER SURFACE-SQUEEGEE COMBINATION

[76] Inventor: Roger A. Jensen, 1922 Main, Kansas City, Mo. 64108

[21] Appl. No.: 629,571

[22] Filed: Jul. 11, 1984

[51] Int. Cl.[4] ..... B41L 13/00; B41L 13/18

[52] U.S. Cl. ..... 101/123; 101/126

[58] Field of Search ..... 101/114, 123, 124, 126

[56] References Cited

U.S. PATENT DOCUMENTS

| | | | |
|---|---|---|---|
| 1,322,667 | 11/1919 | Zemke | 101/114 |
| 1,641,143 | 9/1927 | Allen | 101/114 |
| 1,805,144 | 5/1931 | Jones | 101/211 |
| 1,894,530 | 1/1933 | Bernardo | 101/114 |
| 2,152,274 | 3/1939 | Papazian | 101/114 |
| 2,547,554 | 4/1951 | Beckelman | 101/114 |
| 2,972,303 | 2/1961 | Marchi | 101/426 |
| 2,975,705 | 3/1961 | Gilman | 101/123 |
| 3,137,230 | 6/1964 | Ichinose . | |
| 3,374,731 | 3/1968 | Thorne | 101/124 |
| 3,896,722 | 7/1975 | Farrow | 101/114 |
| 4,023,486 | 5/1977 | Linthicum | 101/120 |
| 4,148,604 | 4/1979 | Bachtiger | 101/114 |
| 4,268,545 | 5/1981 | Hodulik | 427/282 |
| 4,404,903 | 9/1983 | Cronin | 101/123 |

FOREIGN PATENT DOCUMENTS

| | | | |
|---|---|---|---|
| 1175156 | 9/1956 | France . | |
| 572979 | 9/1956 | Italy | 101/114 |
| 591691 | 4/1959 | Italy | 101/114 |
| 367140 | 3/1963 | Switzerland | 101/120 |
| 362891 | 6/1930 | United Kingdom | 101/114 |

*Primary Examiner*—Clyde I. Coughenour
*Assistant Examiner*—William L. Klima
*Attorney, Agent, or Firm*—Lalos, Leeds, Keegan, Marsh, Bentzen & Kaye

[57] ABSTRACT

A screen printing assembly attachable to a silk screen frame including a support frame positionable adjacent and attachable to the screen frame. A squeegee and flood bar assembly deposits and forces ink on and through the screen and onto a substrate disposed adajcent the screen. The assembly includes a mechanism movable along the support frame and the screen frame and a flexible sheet is attached to and moves with the mechanism. The flexible sheet is sealed to the support frame, and forms in part a sealed chamber in which the squeegee and flood bar assembly deposits the ink on the screen. Solvents can be sprayed into the sealed chamber which contains the solvent so that it does not escape not the atmosphere. An inert gas is injected into the chamber displacing the oxygen in it so that the ink does not dry out as rapidly, and safely maintaining the contained solvent. A method for screen printing using this sealed chamber.

27 Claims, 7 Drawing Figures

SCREEN PRINTING APPARATUS AND PROCESS COMPRISING CHAMBER WITH MOVABLE UPPER SURFACE-SQUEEGEE COMBINATION

BACKGROUND OF THE INVENTION

This invention relates to printing apparatuses and processes, and more particularly to automated or manual printing by silk screening. It further relates to all types of ink printing presses using squeegee and flood bar mechanisms.

Numerous printing apparatuses are known, including those recent ones shown in U.S. Pat. Nos. 4,268,545 and 4,404,903, the contents of which are hereby incorporated by reference in their entirety. Basically they show a support frame positionable on top of a screen frame. Means attached to the support frame deposit ink on the screen and then force it through the screen pattern onto an underlying substrate. Solvents can be sprayed on the ink to keep it at its proper consistency and to keep it from drying out. However, these harmful solvents and other chemicals are thereby released into the environment endangering the health of the operator and others standing nearby. Another problem associated with prior screen printing apparatus is that the ink rapidly dries on the screen and the whole process must be shut down so that the screen can be cleaned.

OBJECTS OF THE INVENTION

Accordingly, it is the principal object of the present invention to provide an improved apparatus and process for screen printing.

Another object of the present invention is to provide an improved screen printing apparatus that works on all types of presses, manual or automated, and with all types of inks.

A further object of the present invention is to provide a novel screen printing apparatus that reduces the contamination of the atmosphere by harmful solvents and chemicals.

A still further object of the present invention is to provide an improved screen printing apparatus that exposes the operator thereof to considerably smaller amounts of harmful solvents.

Another object is to provide an improved screen printing apparatus that keeps the ink at its proper consistency for longer periods of time and also keeps it from drying out.

A further object is to provide a novel screen printing apparatus that reduces the frequency of the down time needed to clean the dried ink from the screen thereby increasing the productivity of the screen printing process.

A still further object is to provide an improved screen printing apparatus that is able to print finer details and half tones with a solvent base ink system than previously was possible.

Other objects and advantages of the present invention will become more apparent to those persons having ordinary skill in the art to which the present invention pertains from the foregoing description taken in conjunction with the accompanying drawings.

DESCRIPTION OF THE PREFERRED EMBODIMENT

Figure 1:
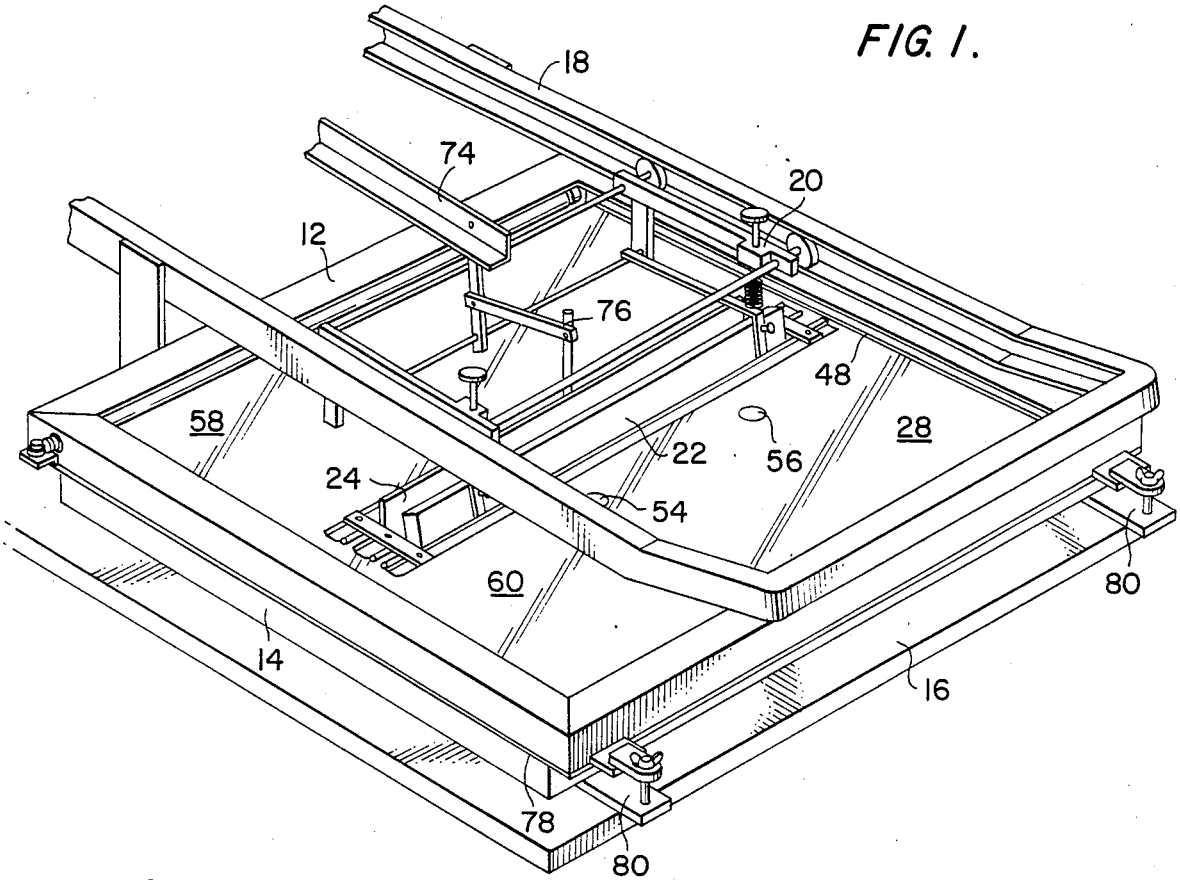
FIG. 1 is a perspective view of a screen printing apparatus embodying the present invention.
Figure 4:
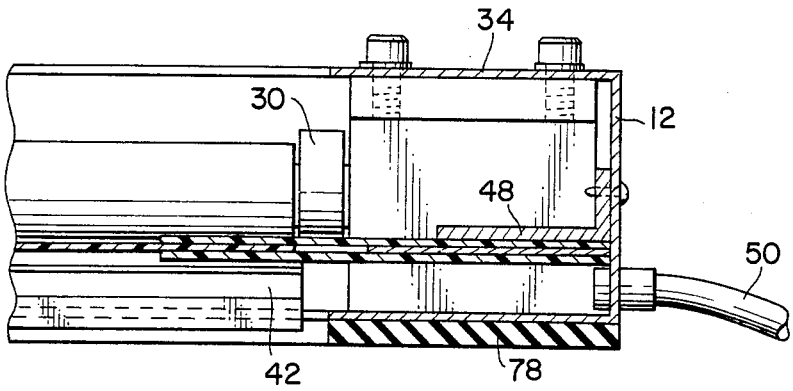
FIG. 4 is an enlarged partial cross-sectional view taken along line 4—4 of FIG. 2.

Referring to FIG. 1, a screen printing apparatus embodying the present invention is illustrated. It comprises generally a support frame 12 to which all of the components of the apparatus are attached, a silk screen frame 14 positioned underneath support frame 12 and supporting a silk screen having the desired pattern thereon, and a press bed or substrate 16 which comprises a level surface on which the stock to be imprinted is placed and on which screen frame 14 rests. Press bed 16 supports a generally horizontal, U-shaped carriage track 18 suspended above the length of support frame 12. A printing head carriage 20 holding the squeegee 22 and flood bar 24 moves in carriage track 18 along the length of support frame 12. Squeegee 22 and flood bar 24 are positioned in a sealed chamber as shown generally at 26 in FIG. 3, and first coat the silk screen 27 with a coating of ink and then sequentially force the ink through the screen onto the substrate. Sealed chamber 26 provides a controlled environment for depositing the ink and for spraying the solvents, thereby being a safer and more productive screen printing apparatus than previously possible.

Figure 5:
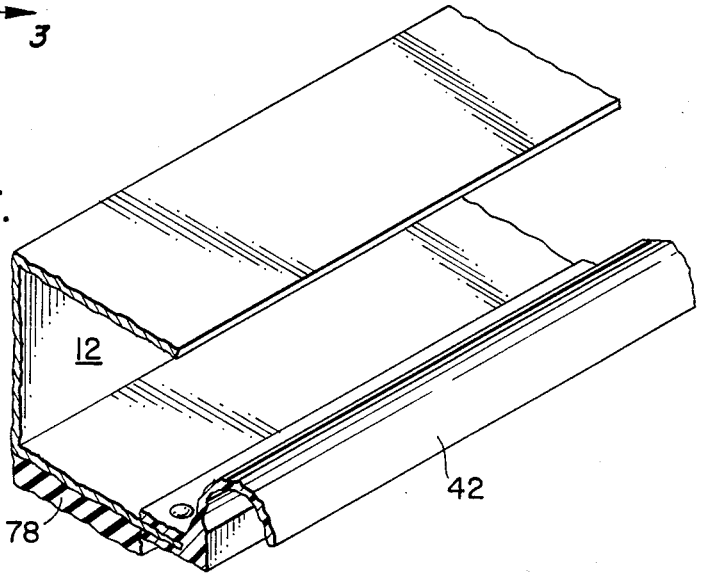
FIG. 5 is an enlarged perspective view of the screen sealing means of the apparatus of FIG. 3 illustrated in isolation.
Figure 3:
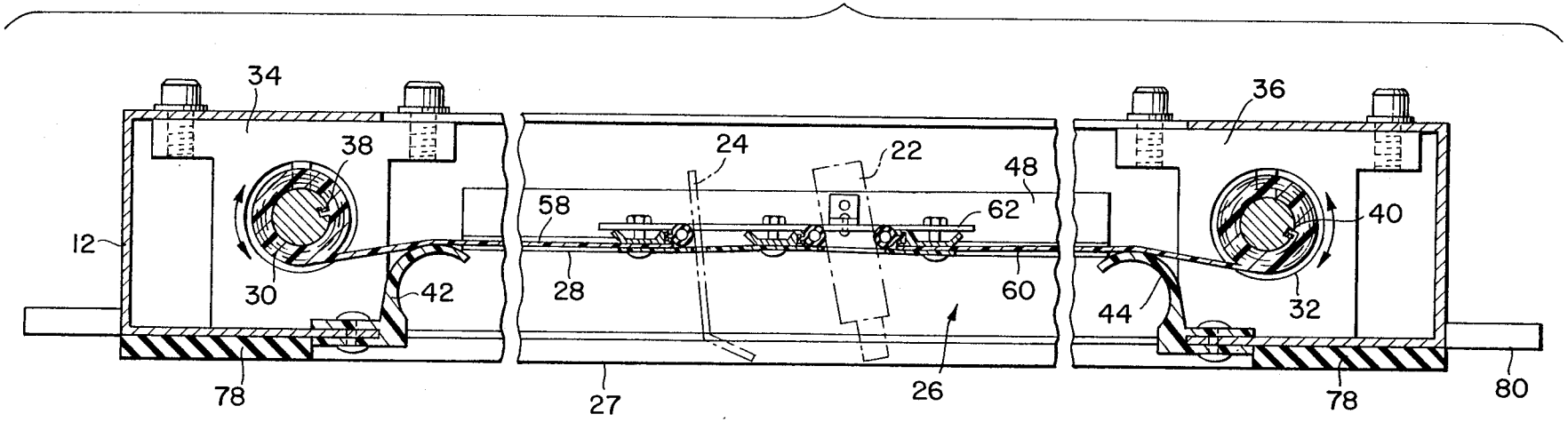
FIG. 3 is a cross-sectional view, partially broken away, taken along line 3—3 of FIG. 2.

Support frame 12 is made from aluminum U-channel, as shown in FIG. 5, cut and welded to size. Attached to squeegee 22 and flood bar 24 is a plastic flexible sheet 28 which extends generally the entire width and length of the support frame. The sheet is attached to squeegee 22 the flood bar 24 and moves with it along the length of the frame. A pair of opposed shaft or rod assemblies 30, 32 mounted at their ends in bearings 34, 36, respectively, which are bolted to the underneath of the top surface of support frame 12 and the sheet is designed to roll over each of the shaft assemblies, as best illustrated in FIG. 3. Tension springs 38, 40 are positioned in each of the shaft assemblies keeping the sheet in a constant rolled up and taut position as it moves relative to support frame 12. Front and back seals shown generally at 42 and 44 extending the width of support frame 12 are mounted to the lower surface of the frame inside of their respective rod assemblies. Referring to FIGS. 3 and 5, it is seen that front and back seals 42, 44 each comprise a curved U-shaped extruded plastic member bolted to the lower surface of the frame and extending upwardly. The seals extend upward against the taut sheet, apply pressure against the sheet and thereby form a seal. Along the edges of the sheet, side seals 46, 48 are provided extending generally the length of frame 12 between front and back seals 42, 44. Side seals 46, 48 comprise extruded plastic members formed with a thin space going down their center and are configured so that the edges of the plastic sheet travel freely within the thin space but are sealed therein. Thus, sealed chamber 26 is defined in part by plastic sheet on the top 28, the side seals 46, 48 along the sides and the front and back seals 42, 44 along the ends over the silk screen.

Figure 2:
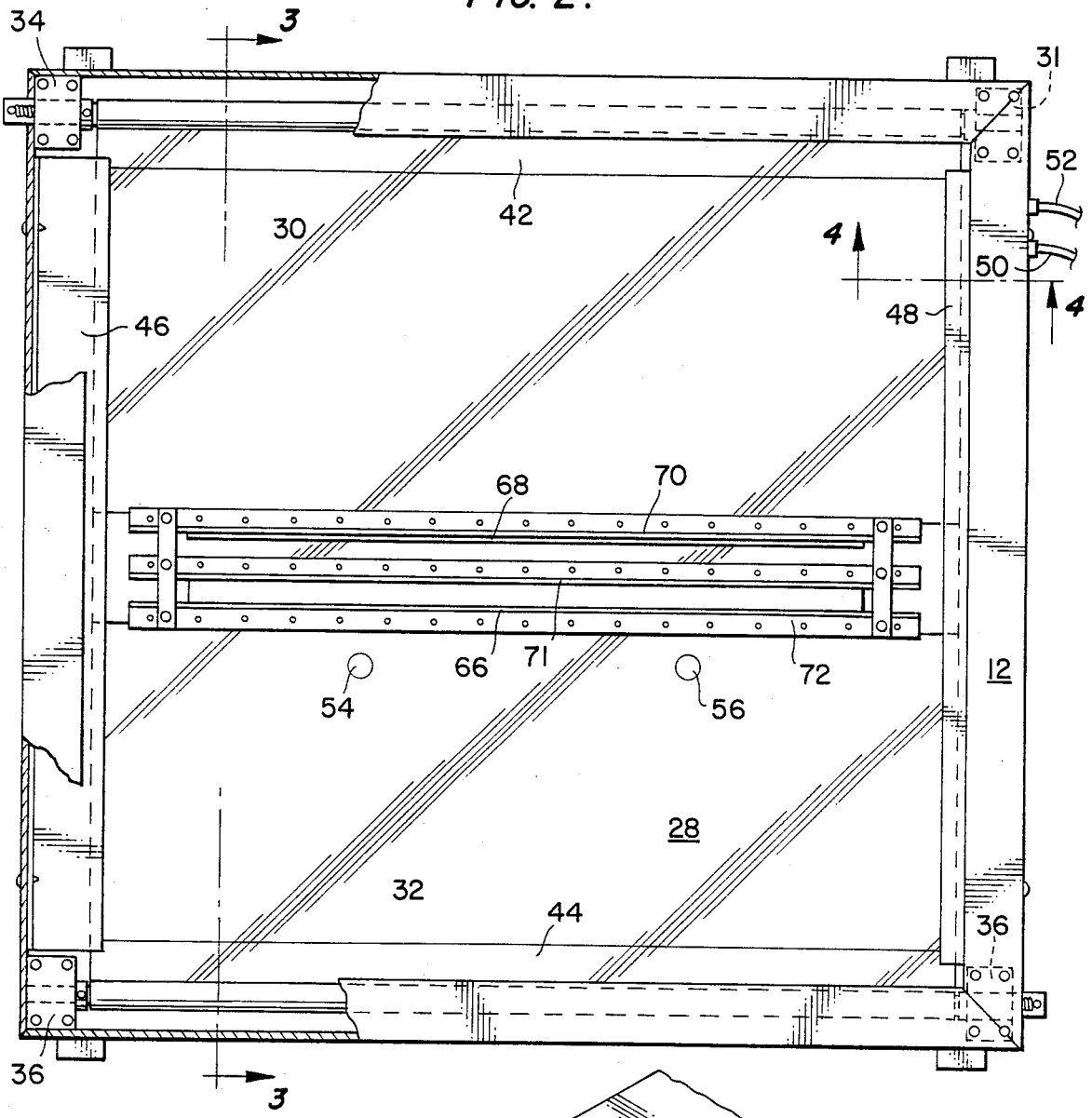
FIG. 2 is a top plan view of the apparatus of FIG. 1 without the track and carriage system and having parts thereof broken away for the sake of clarity.

Into chamber 26 inert gas, such as $CO_2$ or nitrogen, is pumped through a line 50, replacing the oxygen in the chamber and preventing the ink from drying out. Further, suitable solvents can be sprayed into the chamber via line 52 shown in FIG. 2. The solvent is contained within the chamber and does not exhaust into the atmosphere thereby endangering the health of the operator or others in the vicinity. The inert gas minimizes the danger of the contained solvents exploding. It is also possible in this sealed inert gas chamber to print finer details and half tones than were previously possible with other solvent base ink systems. Since the ink does not dry as rapidly, the down time needed to clean the dried ink is reduced and productivity is thereby increased. Also, the ink is kept at its proper consistency. As shown in FIGS. 1 and 2, inking caps 54, 56 extending through the surface of sheet provide access to the inside of chamber 26 to deposit the ink.

Figure 6:
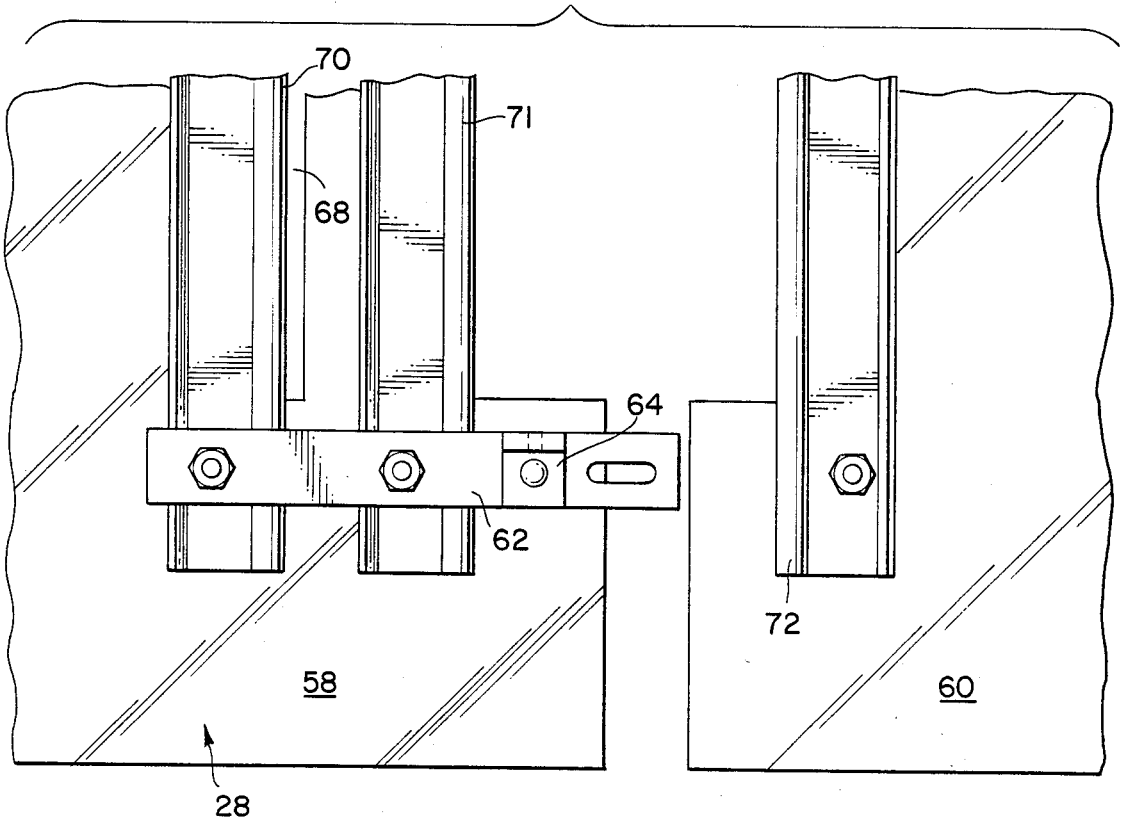
FIG. 6 is an enlarged top plan view of a portion of the connection and attachment mechanism for the plastic sheets of FIG. 2 with the parts thereof shown in exploded relation.
Figure 7:
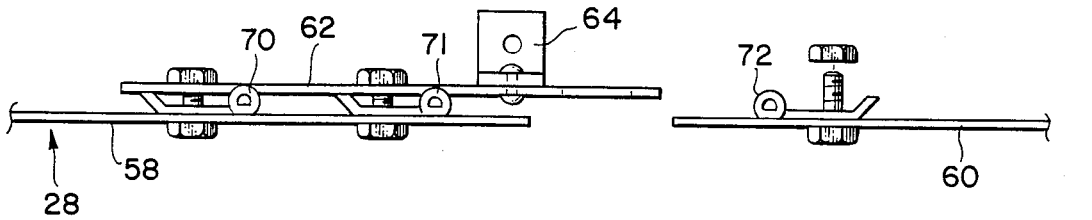
FIG. 7 is a side elevational view of the mechanism of FIG. 6.

Further details of the flexible sheet and the flood bar 24 and squeegee 22 attachment are shown in FIGS. 3, 6 and 7. Referring thereto it is seen that the sheet comprises two portions: a front sheet 60 to which squeegee 22 is attached, and a back sheet 58 to which the flood bar squeegee enclosure unit 62 is attached. This squeegee and flood bar enclosure unit is formed from individual parts made from extruded aluminum and plastic, and when manufactured come in two parts. These two parts are then bolted together as best shown in FIGS. 6 and 7. An attachment member 64 is provided to attach to the side of the squeegee handle. As best shown in FIG. 2, a squeegee opening 66 and a flood bar opening 68 and suitable rubber seals 70, 71, 72 are provided in the sheet.

In a conventional manner, printing head carriage 20 moves to the front of the press by a typical motorized means, flood bar 24 lays a deposit of ink on the silk screen stencil. Then when the carriage moves by carriage drive 74 to the back of the frame the flood bar lifts up by flood bar lift 76 shown in FIG. 1 and squeegee 22 comes in contact with the silk screen thereby forcing the ink through the silk screen pattern onto the substrate. The sheet moves with the carriage and is sealed to the frame at all times thereby forming the sealed chamber. The press illustrated is a semi-automatic clam shell type press that is hinged in the back and lifts the screen frame in the front. However, this invention will work on all types of silk screen presses both manual or automated, and can be used with all types of inks.

A gasket or closed cell neoprene rubber gasket 78 is adhered to the bottom of the metal frame to create a seal between silk screen frame 14 and support frame 12, which are clamped together by suitable tabbed clamps 80 as shown in FIG. 1. This gasket clamping mechanism creates a good seal between the two frames.

It is to be understood that the form of the invention herein shown and described is to be taken as an illustrative embodiment only of the same, and that various changes in the shape, size and arrangement of parts, as well as various procedural changes, may be resorted to without departing from the spirit of the invention, which is limited only by the appended claims.

I claim:

1. A screen printing assembly attachable to a screen frame supporting a screen having a pattern comprising:

a support frame positionable adjacent and attachable to the screen frame, a depositing means connected to said support frame for depositing and forcing an ink coating on and through the screen and onto a substrate disposed adjacent the screen, and a chamber means connected to said support frame and adjacent the screen for defining a sealed chamber in which said depositing means deposits the coating onto the screen, said chamber means having an upper surface movable relative to said support frame and to the screen, said chamber means including a sealing means for sealing said surface to said support frame as said surface moves relative to said support frame, and said depositing means being attached to and movable with said surface for moving said depositing means along the length of the screen.

2. The apparatus of claim 1 including, said depositing means including a squeegee assembly adapted to press ink through the screen.

3. The assembly of claim 1 including, an expelling means operatively connected to said chamber means for expelling the oxygen from said sealed chamber.

4. The assembly of claim 3 including, said expelling means including an injecting means for injecting an inert gas into said sealed chamber.

5. The assembly of claim 1 including, a spraying means operatively connected to said chamber means for spraying solvent into said sealed chamber.

6. The assembly of claim 5 including, an expelling means operatively connected to said chamber means for expelling the oxygen from said sealed chamber.

7. The assembly of claim 1 including, said chamber means including an access means for depositing ink into said sealed chamber.

8. The assembly of claim 1 including, a gasket means positioned along the surface of said support frame adjacent the screen frame for creating a seal between them.

9. The assembly of claim 1 including, a track system generally adjacent said surface and associated with said support frame, and said depositing means including a carriage adapted to run along said track system.

10. The assembly of claim 1 including, said surface comprising a first flexible end sheet, a second flexible end sheet opposite said first end sheet, and an attachment mechanism positioned in a central location of said surface attaching said first and second end sheets and providing a seal therebetween, and said depositing means being connected to said attachment mechanism.

11. The assembly of claim 10 including, a first rod assembly rotatably secured to said support frame and said first flexible end sheet rolling up on said first rod assembly, a second rod assembly rotatably secured to said support frame and said second flexible end sheet rolling up on said second rod assembly, and a tension means connected to at least one said rod assembly for keeping said surface taut as said depositing means moves back and forth relative to said support frame.

12. The assembly of claim 11 including, a first end sealing means positioned generally adjacent said first rod assembly for applying pressure to said first flexible end sheet and creating a chamber means seal between said surface and said support frame.

13. The assembly of claim 12 including, said first end sealing means comprising a plastic member secured to said support frame, curving up to said first flexible end sheet and comprising a part of said chamber means.

14. The assembly of claim 1 including, said depositing means including a squeegee unit attached to said first flexible end sheet, and a flood bar unit attached to said second flexible end sheet.

15. A screen printing assembly attachable to a screen frame supporting a screen having a pattern comprising:

a support frame positionable adjacent and attachable to the screen frame, a depositing means connected to said support frame for depositing and forcing an ink coating on and through the screen and onto a substrate disposed adjacent the screen, said depositing means including a mechanism movable along said support frame and the screen frame, a flexible sheet attached to and movable with said mechanism, a sealing means for sealing said flexible sheet to said support frame, a chamber means connected to said support frame and including said flexible sheet and said sealing means, for defining a sealed chamber in which said depositing means deposits the coating on the screen, an expelling means operatively connected to said chamber means for expelling the oxygen from said sealed chamber, and a spraying means operatively connected to said chamber means for spraying solvent into said sealed chamber.

16. The assembly of claim 15 including, a tensioning means connected to said flexible sheet for keeping said sheet taut as it moves with said mechanism relative to said support frame.

17. A method of printing a pattern on a substrate comprising the steps of:

providing a sealed chamber adjacent a silk screen, spraying a solvent into said sealed chamber to maintain the consistency of the ink, depositing, by a mechanism positioned in said chamber, ink on said silk screen, forcing by means, at least in part in said sealed chamber, said deposited ink through said silk screen onto the substrate, and said depositing and forcing steps including moving an upper sheet surface, to which said mechanism for said depositing and forcing steps is attached, of said sealed chamber relative to the silk screen.

18. The apparatus of claim 15 including, said mechanism including a squeegee assembly adapted to press ink through the screen.

19. The method of claim 17 including, removing the oxygen from said sealed chamber.

20. The method of claim 19 including, said removing the oxygen step including injecting an inert gas into said sealed chamber, thereby replacing the oxygen in said sealed chamber.

21. A screen printing assembly attachable to a screen frame supporting a screen having a pattern comprising:

a support frame positionable adjacent and attachable to the screen frame, a squeegee assembly movable relative to said support frame and positionable generally on the screen to press ink through the screen and onto a substrate disposed generally adjacent the screen, said squeegee assembly having squeegee assembly controls, a chamber means connected to said support frame and generally adjacent the screen for defining a sealed chamber in which said squeegee assembly presses the ink through the screen, said sealed chamber having an upper chamber surface through which said squeegee assembly passes into said sealed chamber, said squeegee assembly controls being positioned generally above said upper chamber surface and outside of said sealed chamber, a spraying means operatively connected to said chamber means for spraying solvents into said sealed chamber, said sealed chamber being adapted to contain the sprayed solvents and said squeegee assembly including a track system positioned outside of said sealed chamber and a carriage adapted to ride on said track system for moving said squeegee assembly along the screen.

22. The assembly of claim 21 including, said upper chamber surface including a flexible sheet, and a sealing means for sealing said flexible sheet to said support frame.

23. The assembly of claim 22 including, an attaching means for attaching said squeegee assembly to said flexible sheet and moving said flexible sheet with it.

24. The assembly of claim 23 including, a tensioning means connected to said flexible sheet for keeping and flexible sheet taut as it moves with said squeegee assembly relative to said support frame.

25. The assembly of claim 24 including, said tensioning means including a roller means positioned above and fixed relative to the screen frame.

26. The assembly of claim 21 including, said squeegee assembly including a flood bar unit for depositing ink on the screen.

27. The assembly of claim 21 including, a sealing means connected to said sealed chamber for sealing said upper chamber surface relative to said support frame and to said squeegee assembly as said squeegee assembly moves relative to said sealed chamber pressing ink through the screen.

* * * * *